US006579126B2

(12) United States Patent
Narumo et al.

(10) Patent No.: US 6,579,126 B2
(45) Date of Patent: Jun. 17, 2003

(54) WEAR-PREVENTIVE MEMORY CARD CONNECTOR

(75) Inventors: Kinzo Narumo, Tokyo (JP); Masayuki Katayanagi, Tokyo (JP)

(73) Assignee: Honda Tsushin Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/058,096

(22) Filed: Jan. 29, 2002

(65) Prior Publication Data

US 2003/0049967 A1 Mar. 13, 2003

(30) Foreign Application Priority Data

Sep. 13, 2001 (JP) ..... 2001-277927

(51) Int. Cl.[7] ..... H01R 24/00

(52) U.S. Cl. ..... 439/630; 439/924.2; 439/135; 439/145

(58) Field of Search ..... 439/435–147, 439/630, 924.2

(56) References Cited

U.S. PATENT DOCUMENTS

| | | | | | |
|---|---|---|---|---|---|
| 4,795,897 | A | * | 1/1989 | Chalendard | 235/482 |
| 5,012,078 | A | * | 4/1991 | Pernet | 235/441 |
| 5,667,408 | A | * | 9/1997 | Broschard, III et al. | 439/630 |
| 6,250,552 | B1 | * | 6/2001 | Hirasawa | 235/475 |

* cited by examiner

*Primary Examiner*—Tho D. Ta
*Assistant Examiner*—James R. Harvey
(74) *Attorney, Agent, or Firm*—Rader, Fishman & Grauer PLLC

(57) ABSTRACT

Disclosed is an improved memory card connector having contact heads to make contact with the contacts of a memory card when inserted in the card receptacle of the memory card connector. It comprises contact limiting means responsive to insertion of the memory card into the card receptacle for preventing the contact heads from touching anywhere on the way to the contacts of the memory card.

2 Claims, 7 Drawing Sheets

WEAR-PREVENTIVE MEMORY CARD CONNECTOR

BACKGROUND OF THE INVENTION

1. Field of the Invention

The present invention relates to a memory card connector for accommodating a thin plastic memory card such as a credit card having an IC memory installed therein or a prepaid card, and more particularly to an improvement in or relating to the contact structure of the memory card connector.

2. Related Arts

Referring to FIG. 11A, a conventional memory card connector 10 has contacts 13 mounted in its card receptacle 11, allowing their contact heads 13*a* to rise resiliently.

Referring to FIG. 11B, the memory card 12 has contacts 12*a* arranged on one side. The contact heads 13*a* of the contacts 13 are made to rub on the shaded area 12*b* of the front end 12*c* of the memory card 12 so that the contact heads 13*a* may be worn or defaced while the memory card is inserted or removed from the connector 10.

After rubbing on the shaded area 12*b,* the contact heads 13*a* of the contacts 13 are put in contact with the contacts 12*a,* thereby making required electric connections therebetween for permitting data signals to be transferred from the memory card 12 to a device whose electric circuits are connected to the contacts 13 of the connector 10. When inserted in the card receptacle 11, the memory card 12 is prevented from slipping off; the card 12 is pushed against the ceiling of the card receptacle 11 by the rising heads of the contacts 13.

Every time the memory card 12 is inserted or removed from the connector 10, the hard contact heads 13*a* rub the shaded area 12*b,* and finally the shaded area 12*c* is worn or defaced in conformity with the trace of the contact heads 13*a,* and the contact heads 13*a* are worn, too. Also, disadvantageously the memory card 12 cannot be held fixedly in the connector 10 so far as friction is used to stop the surface of the memory card 12 sliding over the floor of the receptacle 11 of the connector 10.

SUMMARY OF THE INVENTION

In view of the above, one object of the present invention is to provide a memory card connector whose contact heads are allowed to rub nowhere before making contact with the contacts of a memory card.

To attain this object, a memory card connector having contact heads to make contact with the contacts of a memory card when inserted in the card receptacle of the memory card connector is improved according to the present invention in that it comprises contact limiting means responsive to insertion of the memory card into the card receptacle for preventing the contact heads from touching anywhere on the way to the contacts of the memory card.

With this arrangement the memory card is guaranteed to be free of being worn at the place where otherwise, the memory card would be rubbed by the contact heads.

The memory card connector includes a movable card-ejecting plate slidably fitted in the card receptacle, the limiting means comprising guide means for controlling the movement of the contact heads to the contacts of the memory in such a way that the contact heads may be prevented from touching anywhere on the way to the contacts of the memory card while the memory card is being inserted.

With this arrangement the card-ejecting plate takes a part of releasing the contact heads at the time the contact heads come close to the counter contacts of the memory card.

The movable card-ejecting plate may have card retainers to prevent the memory card from slipping off from the card connector.

Other objects and advantages of the present invention will be understood from the following description of a memory card connector according to one preferred embodiment of the present invention, which is shown in accompanying drawings.

BRIEF DESCRIPTION OF THE DRAWING

FIG. 5A is a longitudinal section of the insulating frame housing taken along the line X—X in FIG. 3 whereas

FIG. 8A is a longitudinal section of the memory card connector, illustrating how the relatively long contact piece works at an early stage whereas

FIG. 9A is a longitudinal section of the memory card connector, illustrating how the relatively short contact piece works at an early stage whereas

FIG. 11A illustrates how a conventional memory card connector works whereas

DETAILED DESCRIPTION OF PREFERRED EMBODIMENT

Figure 1:
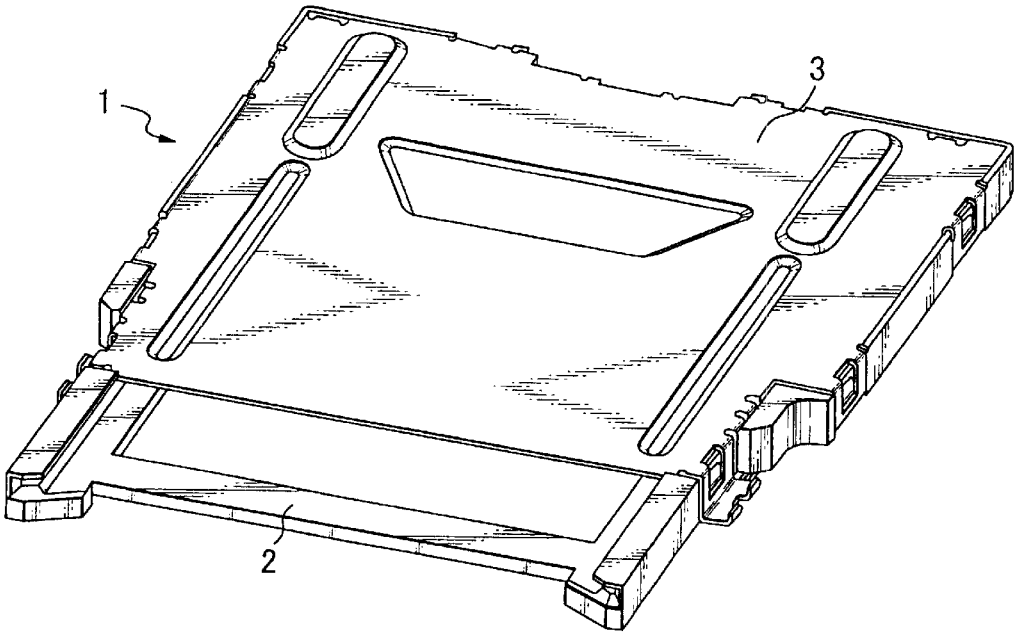
FIG. 1 is a perspective view of the memory card connector.
Figure 2:
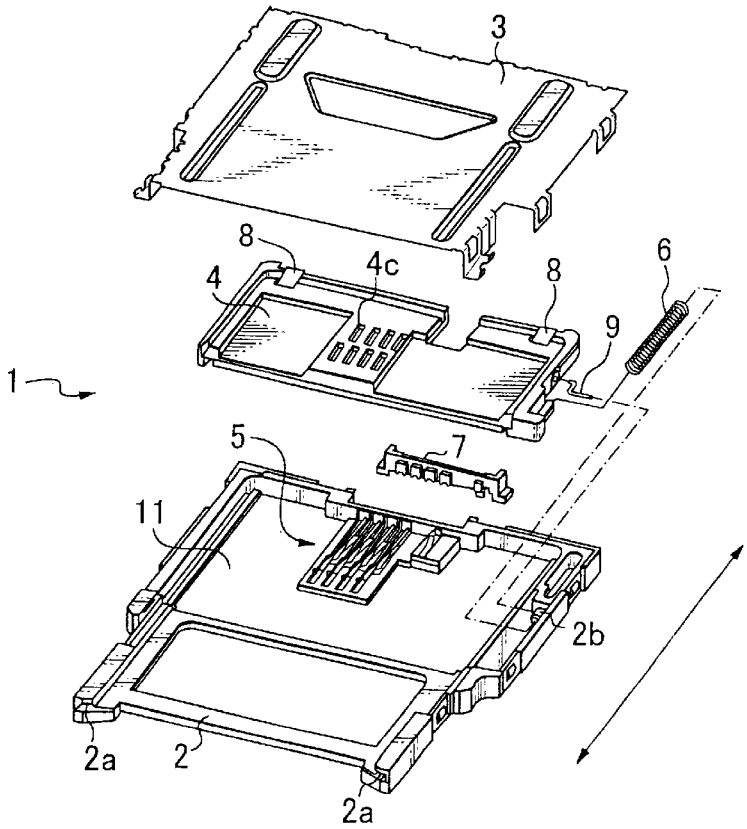
FIG. 2 is an exploded view of the memory card connector.

Referring to FIGS. 1 and 2, a memory card connector according to the present invention comprises an insulating frame housing 2 of synthetic resin, a cover 3 of metal such as stainless steel, a card-ejecting plate 4 for carrying a memory card 12 and contact pieces 5 staggered and arranged side by side at the rear part of the insulating frame housing 2.

The insulating frame housing 2 has two guide slots 2*a* made on its sidewalls for guiding a memory card 12, and a card receptacle 11 formed on its rear part. As seen from FIG. 3, the card receptacle 11 has two guide rails 2*d* provided parallel to its opposite side walls, and a projection 2*b* formed parallel to one side wall for fixing a coiled spring 6, which urges the card-ejecting plate 4 outward all the time. A cover plate 7 is applied to the middle section of the rear side of the insulating frame housing 2.

Figure 3:
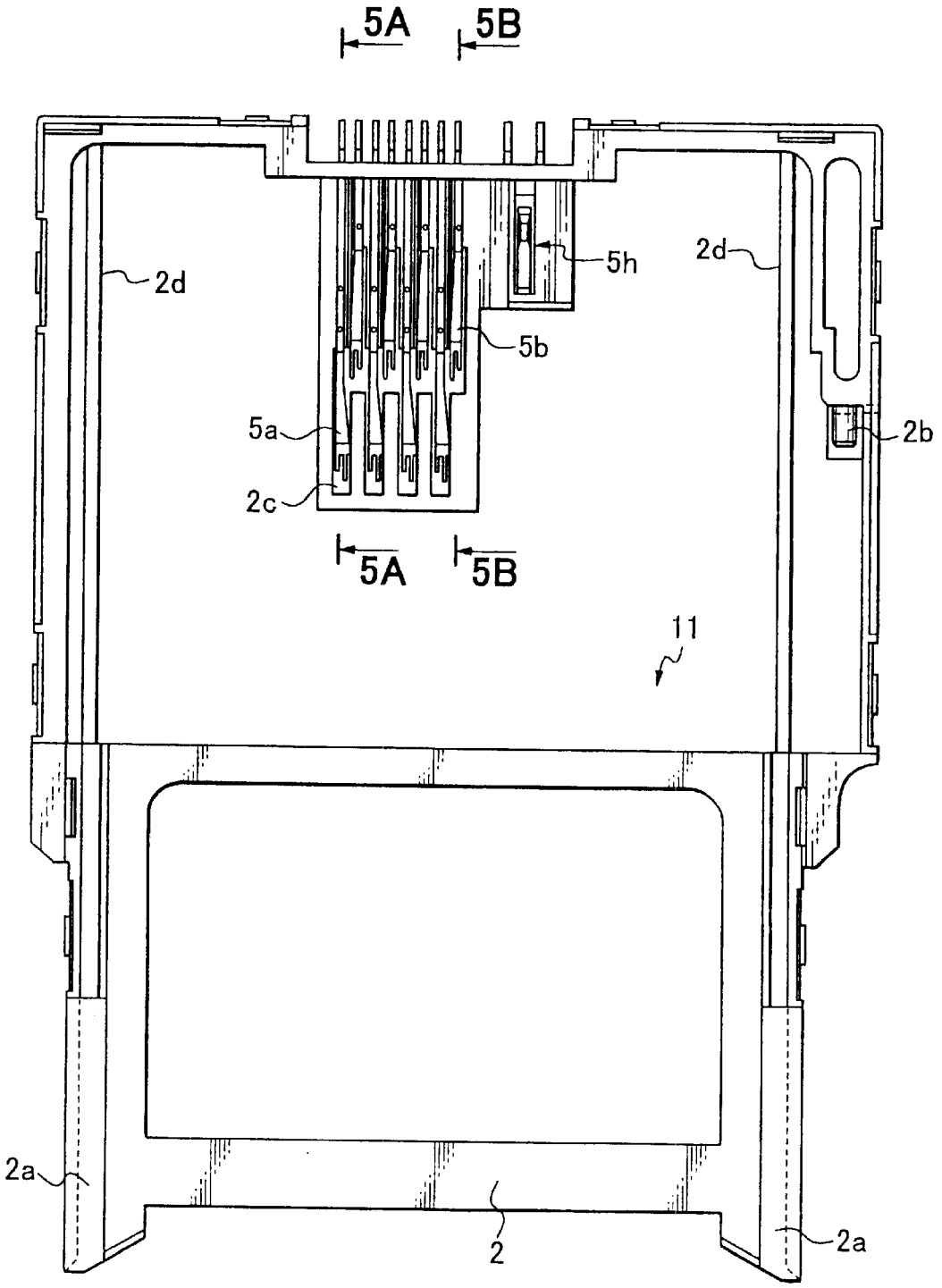
FIG. 3 is a plane view of the insulating frame housing 2 of the memory card connector.
Figure 4A:
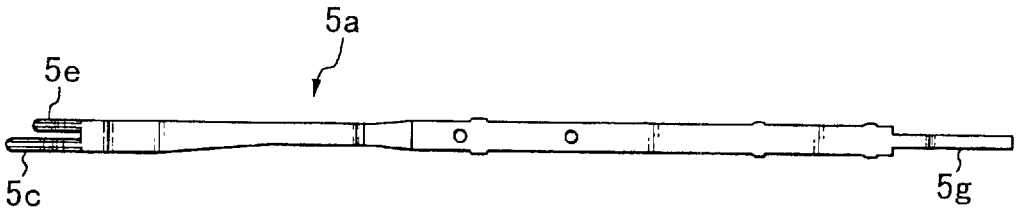
FIG. 4A is a plane view of a relatively long contact piece.
Figure 4B:
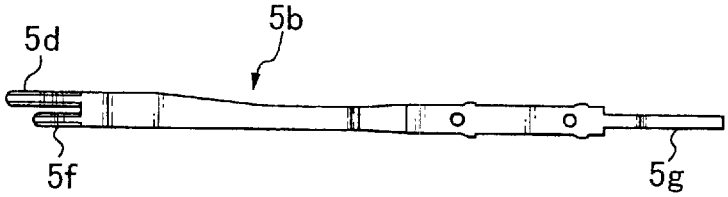
FIG. 4B is a plane view of a relatively short contact piece.
Figure 4C:
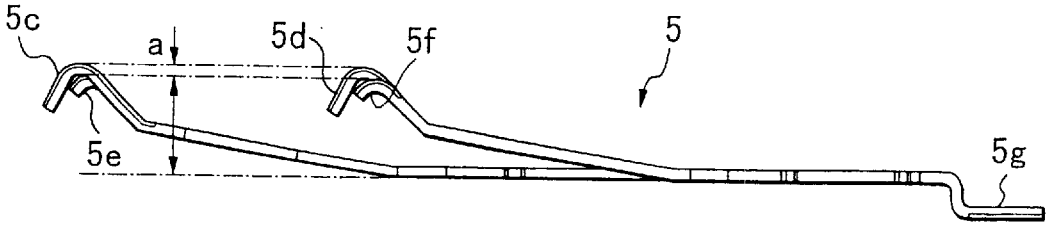
FIG. 4C is a side view of the relatively long and short contact pieces arranged side by side.
Figure 5A:
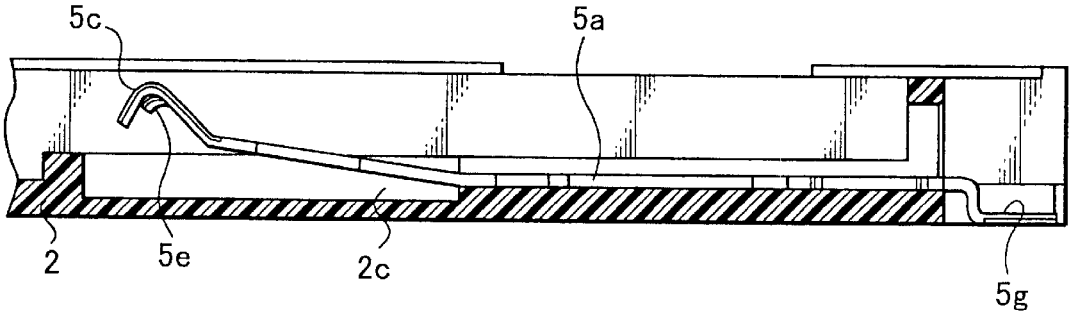
Figure 5B:
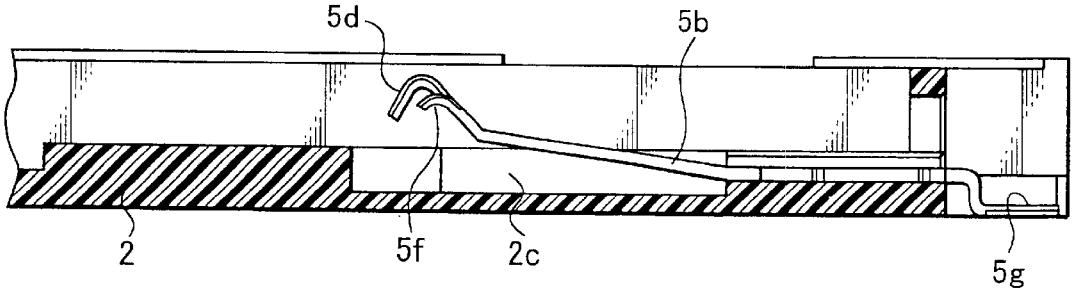
FIG. 5B is a similar longitudinal section taken along the line Y—Y in FIG. 3.

As seen from FIGS. 3 and 4, two different kinds of contact pieces 5 are arranged in staggered pattern, and embedded in the insulating frame housing 2 by insert molding as indicated by 2*c*. An extra contact piece 5*h* is put in contact with a memory card 12 when inserted into the connector 1, thereby permitting electrical detection of the memory card in the card connector.

As seen from FIG. 4, a relatively long contact piece 5*a* and a relatively short contact piece 5*b* are used, each having longer and shorter bifurcations formed at its front end, and a soldering terminal 5*g* formed at its rear end. The soldering terminal 5*g* is to be soldered to a selected conductor in a printed circuit board. The longer bifurcation of each contact piece 5*a* or 5*b* has a curved head 5*c*, 5*d* formed at its end, and the curved head 5*c*, 5*d* is allowed to be applied to a selected conductor of the contact section 12*a* of the memory card 12 to make a required electric connection therebetween. The curved head 5*e*, 5*f* is responsive to insertion of the memory card 12 into the card receptacle 11 for controlling the movement of the curved head 5*c*, 5*d* so as to put them in contact with selected conductors of the contact section 12*a* of the memory card 12. Thus, the curved heads 5*e* and 5*f* of the shorter bifurcations of the contact pieces 5*a* and 5*b* play the part of limiting the curved heads 5*c* and 5*d* of the longer bifurcations to "contact-making" movement to the memory card.

As seen from FIG. 4(*c*), the "non contact-making" curved head 5*e*, 5*f* is a predetermined short distance "a" lower than the "contact-making" curved head 5*c*, 5*d*. Thus, the "non contact-making" curved head 5*e*, 5*f* cannot be put in contact with the contact section 12*a* of the memory card, but they rub against the rear side or ceiling of the card-ejecting plate 4 while the memory card is being inserted in the connector, as later described in detail.

Figure 6:
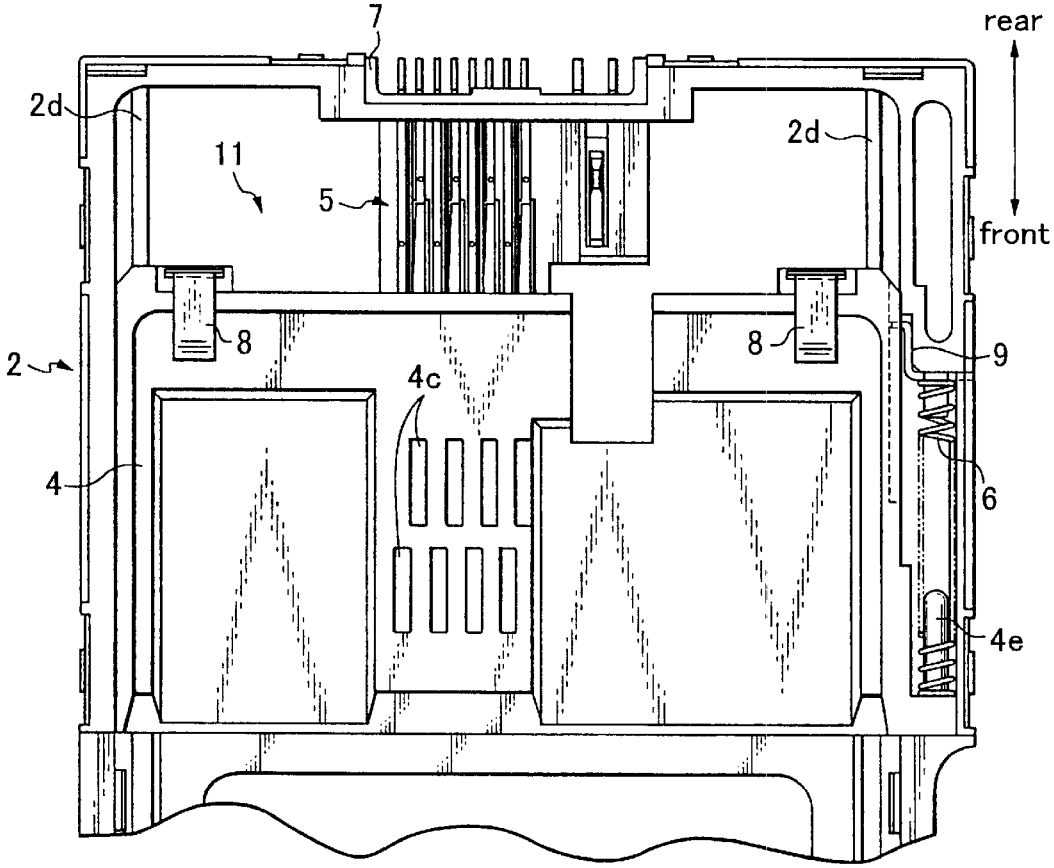
FIG. 6 is a plane view of the rear part of the memory card connector with its cover removed.
Figure 7:
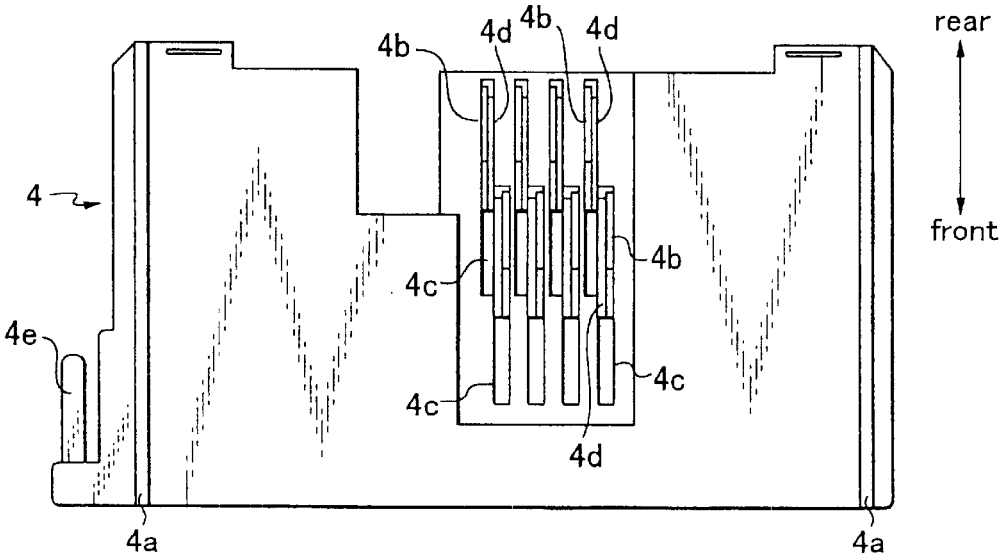
FIG. 7 is a bottom view of the card-ejecting plate of the memory card connector.

As seen from FIGS. 1, 6 and 7, the card-ejecting plate 4 can be moved back and forth with the guide rails 2*d* of the card receptacle 11 (FIG. 3) fitted in the slots 4*a* of the card-ejecting plate 4 (FIG. 7). Also, the card-ejecting plate 4 has guide means 4*b* for controlling the movement of the "non contact-making" curved heads 5*e*, 5*f*.

Specifically the guide means 4*b* is provided on the rear surface of the card-ejecting plate 4 in the form of linear slot, the ceiling of which suppresses the rising of the "non contact-making" curved head 5*e*, 5*f*. The linear slot guide 4*b* is continuous to the rectangular opening 4*c*, which is made at the central area of the card-ejecting plate 4. Each linear slot guide 4*b* has an associated releasing means 4*d* for controlling the movement of the "contact-making" curved head 5*c*, 5*d*. The releasing means 4*d* is a linear slot adjacent to the linear slot guide 4*b*, and is contiguous to the rectangular opening 4*c*.

As seen from FIGS. 2 and 6, the card-ejecting plate 4 has resilient nails 8 provided on its rear corners. These resilient nails 8 can hold a memory card when inserted into the card receptacle of the connector. A coiled spring 6 is press-fitted on the projection 4*e*, thereby applying a resilient push to the memory card all the time.

Also, as seen from FIGS. 2 and 6, the card-ejecting plate 4 has a heart-shaped cam slot made on one side wall, and a crank pin 9 passes through the cam slot and the counter hole of the side wall of the insulating frame housing 2. Thus, a push-and-push type card-ejecting mechanism well known per se is provided.

Figure 8A:
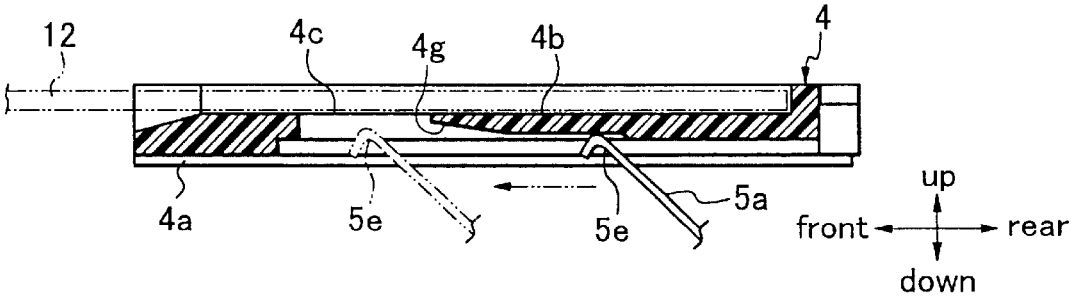
Figure 9A:
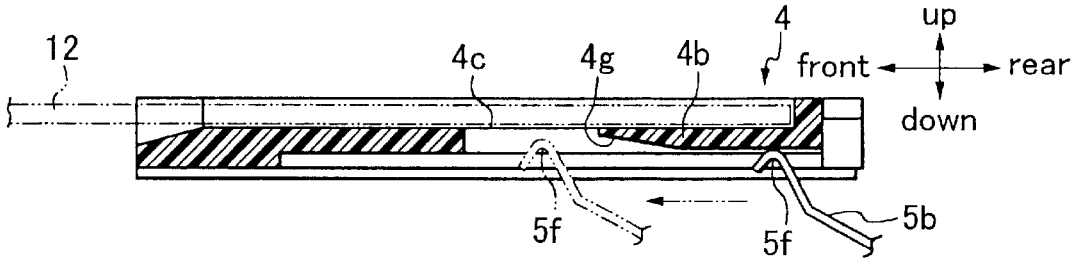

Referring to FIGS. 8A and 9A, the linear slot guide 4*b* is made for each contact piece 5*a* or 5*b*, and the linear slot guide 4*b* is tapered forward as indicated by 4*g*, thereby permitting the "non contact-making" curved head 5*e*, 5*f* to rise gradually toward the rectangular opening 4*c* (phantom lines) as the card-ejecting plate 4 is moved forward.

Figure 8B:
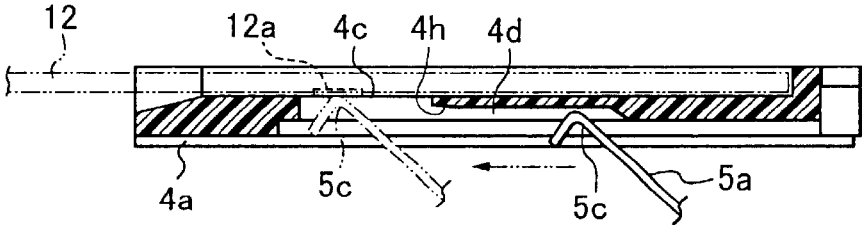
FIG. 8B is a longitudinal section of the memory card connector, illustrating how the relatively long contact piece works at a later stage in inserting the card into the connector.
Figure 9B:
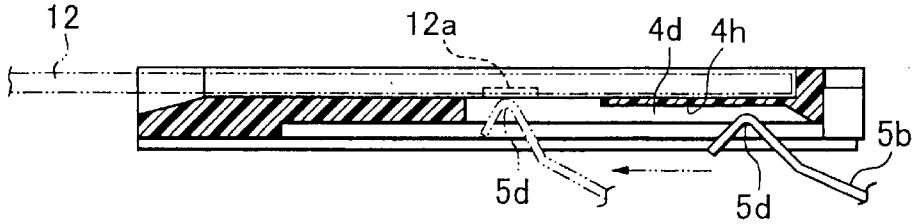
FIG. 9B is a longitudinal section of the memory card connector, illustrating how the relatively short contact piece work at a later stage in inserting the card into the connector.

Referring to FIGS. 8B and 9B, the linear slot guide 4*d* is deep enough for the "contact-making" curved head 5*c*, 5*d* to reach short of the ceiling 4*h* of the linear slot 4*d*, thereby preventing them from rubbing thereon.

Referring to FIGS. 8A and 8B, the "contact-making" curved head 5*c* of the contact piece 5*a* is prevented from rubbing on the ceiling 4*h* of the linear slot releaser 4*d* (see FIG. 8B) while the "non contact-making" curved head 5*e* of the contact piece 5*a* is rubbing on the ceiling of the linear slot guide 4*b*. As seen from FIG. 4C, the "contact-making" curved head 5*c* of the contact piece 5*a* (or the "contact-making" curved head 5*d* of the contact piece 5*b*) is higher than the "non contact-making" curved head 5*e* of the contact piece 5*a* (or the "non contact-making" curved head 5*f* of the contact piece 5*b*) by the short distance "a", and the ceiling 4*h* of the linear slot releaser 4*d* is higher than the ceiling of the linear slot guide 4*b* by a distance longer than the short distance "a".

Referring to FIG. 2 again, the card-ejecting plate 4 is laid in the card receptacle 11 of the insulating frame housing 2 by fitting the opposite guide rails 2*d* of the housing 2 in the opposite slots 4*a* of the card-ejecting plate 4, and the cover 3 is applied to the ejecting plate-and-frame housing assembly, leaving a card slot on its front side. The so assembled memory card connector 1 can be mounted on a printed circuit board of an electronic device such as a charge-counting device by soldering the soldering tails of the connector to selected conductors of the printed circuit of the electronic device.

The manner in which the memory card connector is used is described. A memory card 12 is a rectangular card of plastic material several millimeters thick, and is, for instance, a credit card having an IC memory installed therein or pre-paid card.

The rectangular card 12 is inserted in the card slot with its contact section 12*a* down, and with it's opposite edges fitted in the guide slots 2*a* of the insulating frame housing 2. Then, the card 12 is pushed backward, so that the card 12 enters the card receptacle 11 with its rear side abutting on the rear sidewall of the card-ejecting plate 4. Further insertion of the card 12 moves the card-ejecting plate 4 toward the rear part of the card receptacle by making the coiled spring 6 compressing yieldingly. While the card-ejecting plate 4 is being moved backward, the "non contact-making" curved heads 5*e* and 5*f* of the contact pieces 5*a* and 5*b* are rubbing on the ceilings of the linear slot guides 4*b* whereas the "contact-making" curved heads 5*c* and 5*d* of the contact pieces 5*a* and 5*b* are prevented from rubbing on the ceilings 4*h* of the linear slot releasers 4*d*.

As the card 12 is inserted fully in the connector, the "non contact-making" curved heads 5*e* and 5*f* of the contact pieces 5*a* and 5*b* follow the tapered fronts 4*g* of the linear slot guides 4*b*, thereby allowing the rising of the "non contact-making" curved heads 5*e* and 5*f* (phantom lines), and at the same time, the "contact-making" curved heads 5*c* and 5*d* of the contact pieces 5*a* and 5*b* are allowed to rise and project from the rectangular openings 4*c*, thereby making required electric connections between the "contact-making" curved heads 5*c* and 5*d* and the conductor section 12*a* of the card 12. In this position the "non contact-making" curved heads 5*e* and 5*f* remain at a level lower than the "contact-making" curved heads 5*c* and 5*d* by the short distance "a", and therefore, the "non contact-making" curved heads 5*e* and 5*f* remain below the rectangular openings 4*c,* and hence, apart from the conductor section 12*a* of the card 12.

Figure 10:
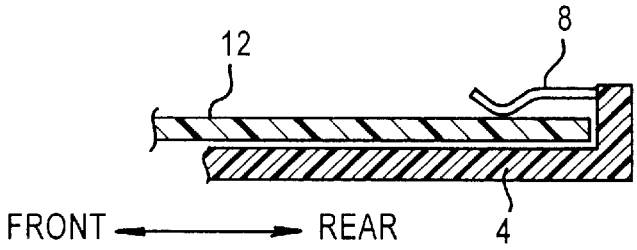
FIG. 10 shows how each card retainer of the connector works.
Figure 11A:
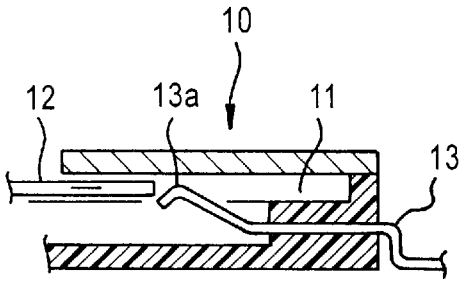
Fig.11A PRIOR ART
Figure 11B:
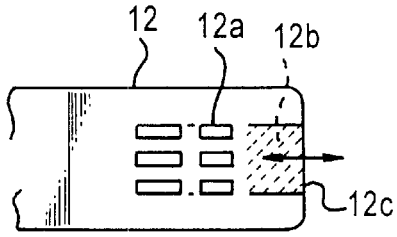
Fig.11B PRIOR ART
FIG. 11B shows the area of the memory card which is apt to be defaced by the rubbing of the contact heads.

The card-ejecting plate 4 is moved backward more or less subsequent to the complete insertion in the connector to be put in its stopping position, where it is prevented from moving further through the action of the crank pin 9 in the heart-shaped cam slot. The card-ejecting plate 4 is fixedly held by the resilient pinching nails 8 so that it may be prevented from slipping off, as seen from FIG. 10. Depression of the extra contact 5*h* permits insertion of the memory card 12 into the card receptacle 11 to be detected electrically.

The crank pin can be released from the card-catching position by pushing the memory card 12 backward, thereby permitting the card-ejecting plate 4 to move forward under the resilient influence of the coiled spring 6.

When the card-ejecting plate 4 is moved forward, the "non contact-making" curved heads 5*e* and 5*f* of the contact pieces 5*a* and 5*b* are pushed down by the linear slot guides 4*b* in reverse to insertion of the memory card 12. At the same time, the "contact-making" curved heads 5*c* and 5*d* of the contact pieces 5*a* and 5*b* are pulled down to be held apart from the ceilings 4*h* of the linear slot releasers 4*d*.

As may be understood from the above, the "non contact-making" curved heads 5*e* and 5*f* of the contact pieces 5*a* and 5*b* are made to slide on the ceilings of the linear slot guides 4*b* whereas the "contact-making" curved heads 5*c* and 5*d* of the contact pieces 5*a* and 5*b* are allowed to move without rubbing on the ceilings 4*h* of the linear slot releasers, and to abut on the contact section 12*a* of the memory card 12 at the time the memory card 12 is fully inserted in the connector.

The memory card 12 when inserted in the card receptacle can be fixedly held by the resilient nails 8 to prevent the slipping-off of the memory card from the connector.

What is claimed is:

1. A memory card connector having contact heads to make contact with contacts of a memory card when inserted in a card receptacle of the memory card connector, comprising:

a contact limiting means responsive to insertion of the memory card into the card receptacle for preventing the contact heads from touching anywhere on the way to the contacts of the memory card, wherein the contact limiting means includes a movable card-ejecting plate which is slidably fitted in the card receptacle and which has an upper face for carrying a memory card laid on the upper face, the movable card-ejecting plate comprising a guide means for controlling the movement of the contact heads to the contacts of the memory in such a way that the contact heads may be prevented from touching anywhere on the way to the contacts of the memory card while the memory card is being inserted, and the movable card-ejecting plate having rectangular openings which are contiguous to the guide means and through which the contact heads are to make contact with the contacts of the memory card.

2. A memory card connector according to claim 1, wherein the movable card-ejecting plate has card retainers to prevent the memory card from slipping off from the card connector.

* * * * *